US008579783B2

(12) United States Patent
Krammer et al.

(10) Patent No.: US 8,579,783 B2
(45) Date of Patent: Nov. 12, 2013

(54) WEIR AND CHOKE PLATE FOR SOLID BOWL CENTRIFUGE

(75) Inventors: Gernot Krammer, Graz (AT); Laurentiu Pasol, Paris (FR); Jean-Marc Huyghe, Le Poinconnet (FR)

(73) Assignee: Andritz S.A.S., Velizy-Villacoublay (FR)

( * ) Notice: Subject to any disclaimer, the term of this patent is extended or adjusted under 35 U.S.C. 154(b) by 763 days.

(21) Appl. No.: 12/792,872

(22) Filed: Jun. 3, 2010

(65) Prior Publication Data

US 2011/0003677 A1 Jan. 6, 2011

Related U.S. Application Data

(60) Provisional application No. 61/222,616, filed on Jul. 2, 2009.

(51) Int. Cl.
*B04B 1/20* (2006.01)
*B04B 11/02* (2006.01)

(52) U.S. Cl.
USPC ..... 494/53; 494/56

(58) Field of Classification Search
USPC ..... 366/53–54, 56–57; 210/380.1, 380.3; 494/53–54, 56–57
See application file for complete search history.

(56) References Cited

U.S. PATENT DOCUMENTS

| | | | | |
|---|---|---|---|---|
| 3,580,492 | A * | 5/1971 | Schnittger et al. | 494/53 |
| 4,575,370 | A * | 3/1986 | LaMontagne | 494/56 |
| 4,764,163 | A * | 8/1988 | Caldwell | 494/56 |
| 4,950,219 | A * | 8/1990 | Luchetta | 494/53 |
| 5,169,377 | A | 12/1992 | Schlip et al. | |
| 5,217,428 | A * | 6/1993 | Schlip et al. | 494/56 |
| 5,593,377 | A * | 1/1997 | Figgener et al. | 494/56 |
| 7,001,324 | B2 | 2/2006 | Hensley et al. | |
| 7,326,169 | B2 * | 2/2008 | Bruning et al. | 494/56 |
| 8,157,716 | B2 * | 4/2012 | Madsen | 494/56 |
| 8,465,405 | B2 * | 6/2013 | Horstkotter et al. | 494/53 |
| 2004/0058796 | A1 * | 3/2004 | Feldkamp et al. | 494/56 |
| 2005/0164861 | A1 * | 7/2005 | Bruning et al. | 494/56 |
| 2010/0167901 | A1 * | 7/2010 | Madsen et al. | 494/60 |
| 2011/0003677 | A1 * | 1/2011 | Krammer et al. | 494/37 |

FOREIGN PATENT DOCUMENTS

| | | |
|---|---|---|
| DE | 1 452 260 | 12/1938 |
| DE | 1 183 023 | 12/1964 |
| DE | 1 782 260 | 8/1971 |
| DE | 34 46 166 | 6/1986 |
| DE | 37 28 901 | 11/1988 |
| DE | 38 22 983 | 1/1990 |

(Continued)

*Primary Examiner* — Charles E Cooley
(74) *Attorney, Agent, or Firm* — Nixon & Vanderhye P.C.

(57) ABSTRACT

A centrifuge for separating solid-liquid mixtures including: a rotating bowl having a head wall with at least one drain opening for clarified liquid, said bowl having a rotational axis; a weir plate fixed to the head wall of the bowl and rotating with bowl, wherein the weir plate is aligned with the at least one drain opening; a choke plate coupled to and rotating with the rotating bowl, the choke plate having surface axially aligned with the drain opening or the weir plate, wherein said choke plate is movable axially with respect to the head wall, and a gap having between the drain opening or the weir plate, wherein the gap has a radially inward inlet receiving the clarified liquid from the bowl and a radially outward outlet for discharging the clarified liquid from the bowl.

12 Claims, 7 Drawing Sheets

(56) References Cited

FOREIGN PATENT DOCUMENTS

| | | | |
|---|---|---|---|
| DE | 39 21 327 | | 1/1991 |
| DE | 4132044 | C1 * | 11/1992 |
| DE | 43 20 265 | | 12/1994 |
| DE | 697 13 651 | T2 | 2/2003 |
| DE | 102 03 652 | | 8/2003 |
| DE | 10 2004 019 368 | | 11/2005 |
| EP | 1 588 769 | | 10/2005 |
| GB | 2 233 258 | | 1/1991 |
| WO | 03/074185 | A1 * | 9/2003 |
| WO | 2004/035221 | | 4/2004 |

* cited by examiner

WEIR AND CHOKE PLATE FOR SOLID BOWL CENTRIFUGE

RELATED APPLICATION

This application claims the benefit of U.S. Provisional Patent Application Ser. No. 61/222,616, filed Jul. 2, 2009, which is incorporated by reference in its entirety.

BACKGROUND OF THE INVENTION

This invention relates to a solid bowl centrifuge for separating solids from a liquid, for different applications, such as in a waste water treatment facility. In particular, the invention relates to a weir and choke plate assembly for a solid bowl centrifuge.

Conventional solid bowl centrifuges typically are embodied as helical conveyor centrifuges having a screw within a bowl. The screw and bowl are coaxial and rotate independently of each other. The screw rotates to transport solids in a liquid solids mixture to a solids discharge end of the centrifuge. The rotations of the screw conveyor and the bowl apply a centrifugal force causing the liquid and solids in the bowl to form an annular ring having an outer surface against the wall of the bowl and an inner cylindrical ring surface (the "pond level") that surrounds a gas filled void at the center of the centrifuge.

Solids in the rotating bowl tend to settle radially outward on the bowl wall and are moved by the screw to the solids discharge end of the centrifuge. The clarified liquid, also referred to as centrate, is radially inward and flows to a liquid discharge at a head wall which is at an end of the centrifuge opposite to the solids discharge end.

Weir assemblies are attached to the head wall of the centrifuge. The weir assembly typically includes a passage for the discharge of liquid centrate from the bowl of the centrifuge. The conventional weir assembly is adjustable to regulate the level of the liquid in the bowl. For example, German Patent Publication DE 1 183 023 discloses a weir assembly having two concentric ring-disks forming a V-shaped drain opening that is radially adjusted during operation of the centrifuge to regulate the liquid level in the centrifuge bowl. Other adjustable weir assemblies and weir aperture geometries are disclosed in DE 1 452 260. Similarly, DE 39 21 327 discloses weir elements for weir assemblies formed of flaps, slides and wedges arranged adjacent drain openings in the head wall of a centrifuge. These weir elements rotate with the bowl of the centrifuge and are adjusted radially by a set collar. The pond level of the liquid centrate in the centrifuge bowl, as well as the quantity of the centrate being drained, is regulated by adjusting the radial position of the set collar.

DE 102004019368 discloses a solid bowl centrifuge with an adjustable weir system having adjacent weir plates in which the inner weir plate rotates with bowl and the outer weir plate is fixed. The outer weir plate does move in a small set-wise rotational movement that allows for an adjustment of the effective gap between the outer and inner weir plates. The adjusting mechanism for the outer weir plate is eccentrically mounted with respect to the rotating centrifuge. The centrate flows through the gap between weir plates.

DE 43 20 265 discloses a solid bowl centrifuge with an adjustable weir having a non-rotating choke plate, also referred to as a throttle plate. The choke plate is axially displaced, arranged outside of the bowl, and is adjacent a rotating liquid drain openings in the bowl. The choke plate is in a plane parallel to the drainage cross sections for the liquid and of the liquid pond level in the bowl of the centrifuge. As the gap between the choke plate and drain openings decreases, the liquid drainage flow resistance increases and the liquid pond level in the centrifuge increases by extending radially inward during centrifuge operation.

DE 102 03 652.7 discloses a weir discharge with a rotating weir plate and a non-rotating choke plate that creates a liquid centrate discharge opening in which at least one nozzle is assigned to an outlet for discharging clarified liquid from the drum. Energy may be saved depending on the relative angle of the nozzles. Another energy savings concept for a weir is disclosed by WO2004035221.

U.S. Patent Application Publication US2004/0058796 discloses a weir discharge system where the centrate is directed outwards through a non-rotating annular cup with at least one opening that is connected to the centrifuge housing. The position of the annular cup can be adjusted during operation and thereby the centrate flow and liquid pond level are controlled.

DE 37 28 901 C1 discloses a centrate discharge system having inner and outer rotating weir plates between which is a fixed gap opening. The inner weir plate has a larger inner diameter than does the outer weir plate. The fixed gap between the weir plates creates a flow path for the centrate. After the gap is closed by a flange, the liquid level rises until the centrate flows over the edge of the outer weir.

U.S. Pat. No. 5,169,377 discloses a weir discharge system in which the liquid outflow is regulated by an annular discharge gap between rotating ring-weir plates. The outer ring weir plate moves axially to change the size of the gap between the ring and a circular discharge opening.

A weir and choke plate assembly should provide one or more of an easy adjustment of the liquid pond level in the centrifuge, a relatively low torsion moment to drive the assembly, a gas seal to isolate the gas filled void in the centrifuge from ambient atmosphere, and a decanting function in which the liquid level in the centrifuge is periodically raised to a radially inward drain opening.

BRIEF DESCRIPTION OF THE INVENTION

A solid bowl centrifuge has been developed having a variably adjustable weir choke and plate assembly. By axially adjusting the choke plate, the liquid pond level in the centrifuge bowl may be regulated in an operationally reliable manner. The centrate discharges from the centrifuge head in a radially outward direction through a radial gap between a weir plate and a choke plate. The opening of the gap is directed radially outwards.

The weir and choke plates rotate at the same rotational speed as the bowl. Because the plates rotate together, the total torsion moment applied to the plates is lower as compared to the torsion moments applied to a weir plate and choke plate that rotate at different speeds. Due to the lower torsion moment, reduced energy is required to drive a centrifuge having weir and choke plates that rotate at the same speeds.

The adjusting device for varying the level of the liquid in the centrifuge bowl comprises an open radial gap defined by a distance between the parallel opposing ring faces of the weir plate and choke plate. The width can be varied between total closure up to a distance where the centrate does not contact the choke plate.

The gap between the weir and choke plates creates a flow resistance that increases as the axial distance of the gap decreases. As the gap closes and the flow resistance increases, the pressure of the liquid increases to raise the level of the liquid in the bowl. As the gap increases, the level of the liquid in the bowl drops until the flow is dictated by a natural crest height over the weir plate.

The weir and choke plate assembly disclosed herein may allow for a periodic separate discharge of accumulated top layered fractions of the centrate without significant interference in the operation of the centrifuge. The choke plate may include apertures to allow an outflow of the centrate if the regular flow through the radial gap is too low or blocked. The flow through the apertures in the choke plate and the flow through the gap can be combined or separated in the discharge casing.

Moreover, the top layer of the liquid in the centrifuge may be decanted periodically by reducing the radial gap to raise the liquid level and eventually an overflow of the centrate through the apertures in the choke plate.

A centrifuge has been developed for separating solid-liquid mixtures comprising: a rotating bowl having a head wall with at least one drain opening for clarified liquid, said bowl having a rotational axis; a weir plate fixed to the head wall of the bowl and rotating with bowl, wherein the weir plate is aligned with the at least one drain opening; a choke plate coupled to and rotating with the rotating bowl, the choke plate having surface axially aligned with the drain opening or the weir plate, wherein said choke plate is movable axially with respect to the head wall, and a gap between the drain opening or the weir plate, wherein the gap has a radially inward inlet receiving the clarified liquid from the bowl and a radially outward outlet for discharging the clarified liquid from the bowl.

A method for clarifying liquid in a liquid and solid mixture has been developed using a solid bowl centrifuge having a rotating bowl, a choke plate and a weir plate, the method comprising: feeding the liquid and solid mixture into the bowl; forming the liquid and solid mixture in the bowl into an annulus having an inner annular liquid surface by rotating the bowl; draining clarified liquid from the liquid and solid mixing by draining a radially inward portion of the annulus through an opening in the head wall and over a radially inward edge of the weir plate fixed to and rotating with the head wall, and forming a gap between the choke plate and the head wall or weir plate, wherein the gap extends in a generally radial direction and includes a radially inward inlet to receive the clarified liquid and a radially outward outlet to discharge the clarified liquid.

DETAILED DESCRIPTION OF THE INVENTION

Figure 1:
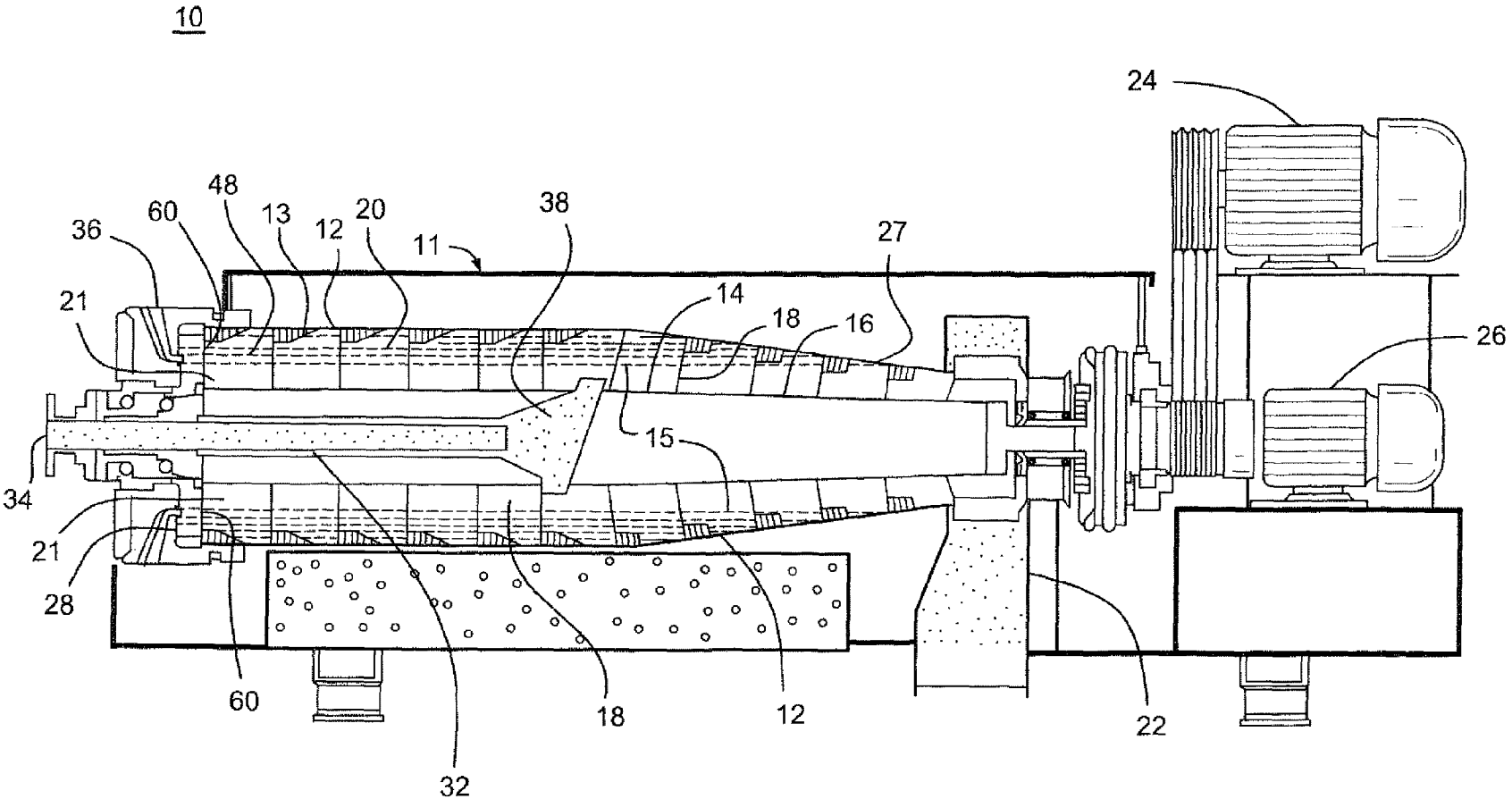
Figure 1 (Prior Art)
FIG. 1 is a side view of a solid bowl helical conveyor centrifuge, shown in partial cross-section.

FIG. 1 is a side view of a conventional solid bowl centrifuge 10. A rotating inner screw assembly 14 transports solids along the length of a bowl 12. The bowl 12 rotates to centrifugally displace a liquid solid mixture 13 radially outward against the bowl that surrounds the screw. The bowl 12 may be a drum, basket or other generally annular container and they are collectively referred to herein as a "bowl." A housing 11 of the centrifuge encloses and supports the bowl 12 and screw 14 assembly.

A mixture of solids and liquid 13 is typically held in a holding pool and enters an axial inlet 34 of a feed pipe 32 that discharges the mixture to a distributor 38 at a center portion of the bowl. The distributor 38 discharges the liquid and solids mixture 13 in a central portion of the channel 20. The liquid and solids mixture flows through the feed pipe 32 and to a generally conical distributor 38 that rotates with the screw body 16. The distributor has radially outward openings through which the liquid and solids mixture pass through the screw body 16 and enter a center portion of the channel 20.

Once in the rotating bowl, the mixture 13 forms an annular ring shape bounded an inside surface of the rotating bowl. The solids tend to settle radially outward against inside surface the rotating bowl. The radially inward portion of the mixture 13 is clarified liquid, which is referred to as centrate.

A screw assembly 14 coaxial to the bowl and within the bowl moves the solids to a solids discharge casing 22 at one end of the bowl. The opposite end of the centrifuge includes a head wall 60 of the centrifuge. The screw assembly 14 has a cylindrical screw body 16 and a screw blade 18 forming a helix around the screw body. Turning the screw blade 18 moves the solids to the end of the bowl having the discharge casing 22.

The liquid solid mixture 13 forms an annulus in the bowl with a cylindrical inner liquid surface 15 facing a gas filled annular void 21 between the mixture and a cylindrical body of the screw. The annular liquid surface level 15 is referred to as the "pond level". The pond level 15, in a radial direction, is generally uniform in the channel. An annular channel 20 between the inside surface of the bowl 12 and a cylindrical screw body 16 defines a passage for the liquid and solids mixture 13 in the centrifuge 10. A gas filled void 21 forms in a region of the channel between the pond level of the mixture 13 and the outer surface of the cylindrical screw body 16.

The screw body 16 and bowl 12 are separately rotatably driven by, for example, a motor 24 and a generator 26, respectively. Rotation of the bowl imparts centrifugal forces that cause the liquid and solids mixture to move radially outward in the channel 20 and form an annular ring in the channel 20. The liquid passes through openings and over edges in the screw blade 18 to ensure that the pond level 15 remains uniform through the channel.

The bowl and optionally, the screw body may taper 27 radially inward between the distributor 38 and the discharge casing 22. As the solids material move along the tapered 27 portion of the bowl, the solids are moved radially inward and beyond the liquid surface level in the channel. Once the solids have moved in the channel beyond the liquid surface level, the solids are separated from the liquid and can be discharged through the discharge casing 22.

Figure 2:
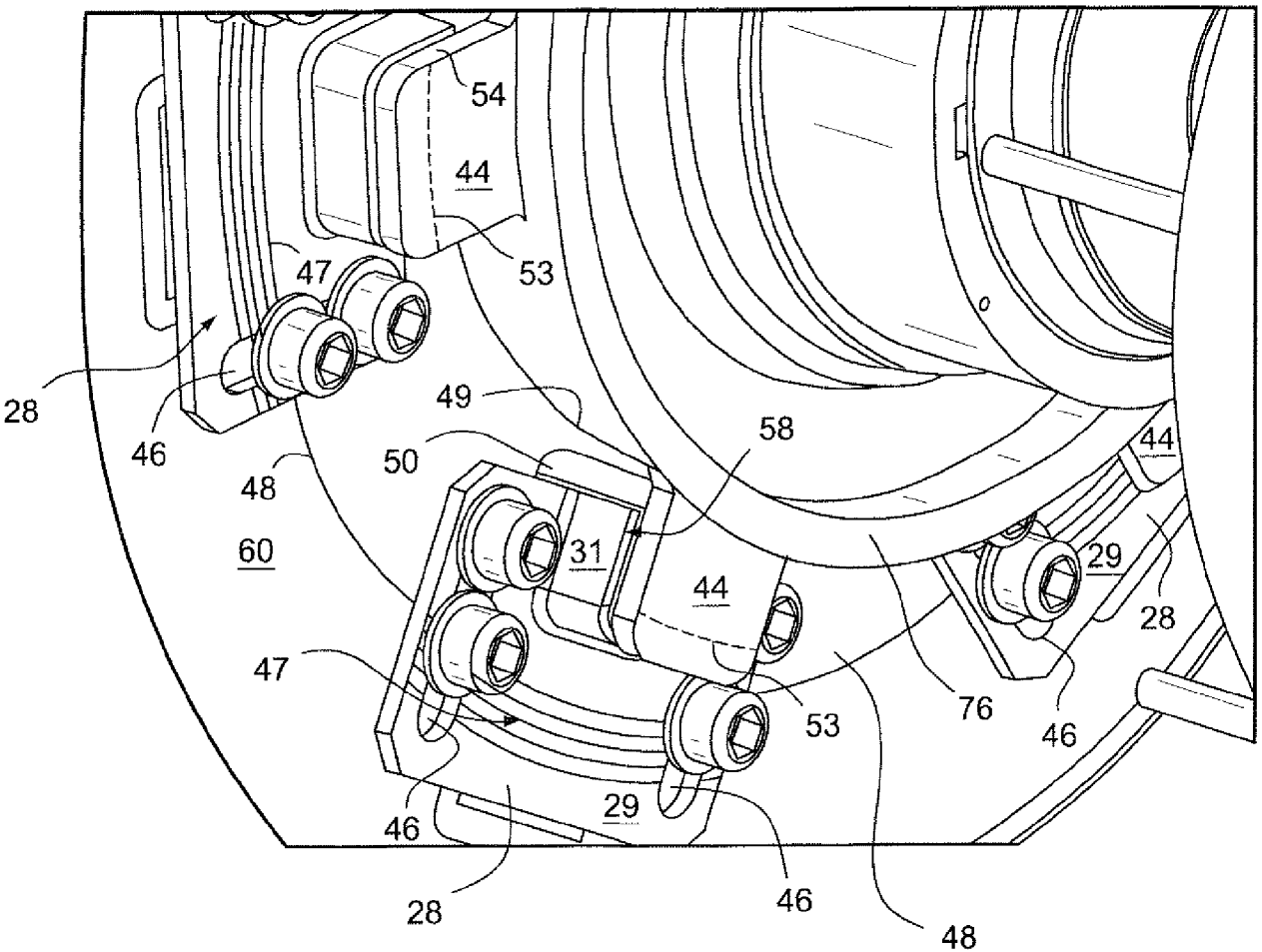
FIG. 2 is a perspective view of the outer surface of a head wall of a bowl of the centrifuge, weir plates attached to the head wall and weir plates attached to a collar.
Figure 3:
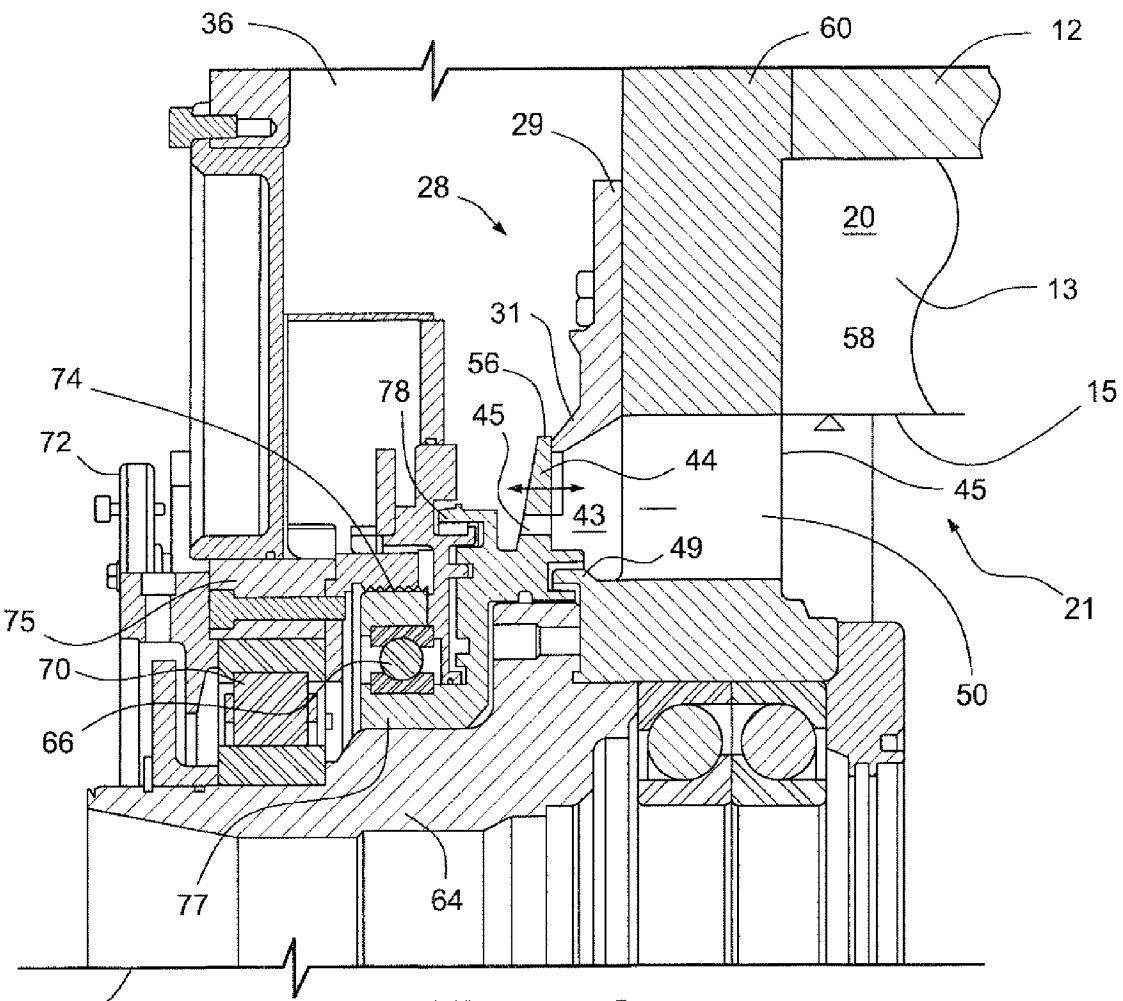
FIG. 3 is a cross-sectional view of an upper-half of head wall of the bowl, choke plate, weir plate and associated mechanism for axially moving the weir plate.
Figure 4:
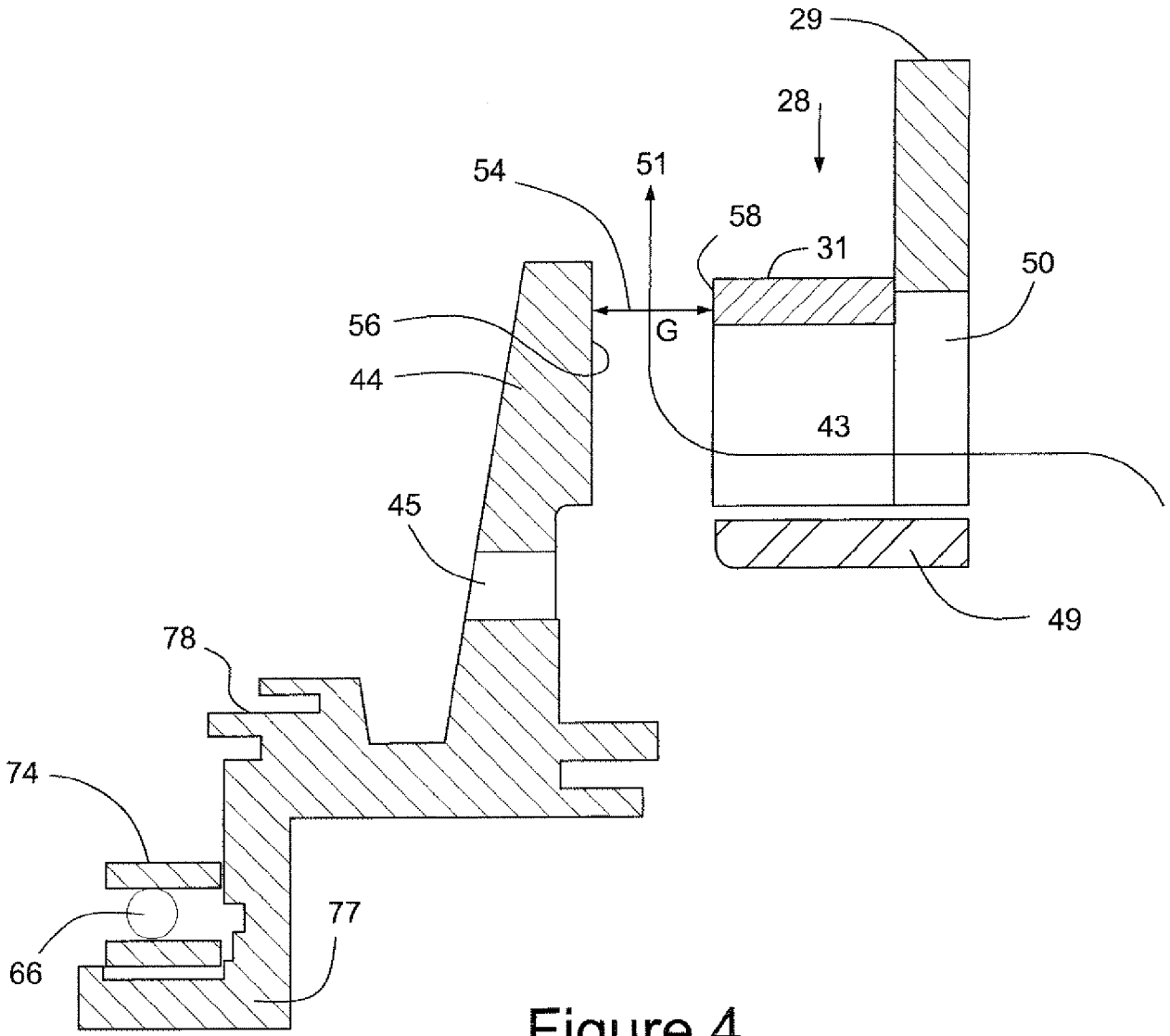
FIG. 4 is a cross-sectional view of a first weir and choke plate assembly having an upper-half of the choke plate outside of the head wall and weir plate showing their relative relationship and the centrate gap between the plates.

A novel assembly of weir plates and choke plates has been developed for a solid bowl helical conveyor centrifuge. FIG. 2 is a perspective view of the outer surface of a head wall 60 of a bowl of the centrifuge, weir plates 28 attached to the head wall and choke plates 44 attached to a collar 76. FIG. 3 shows, in cross-section, a side view of an end portion of the solid bowl helical conveyor centrifuge and particularly shows a portion of the head wall 60, centrate discharge casing 36, the weir plate 28 and the choke plate 44. The choke plate moves axially with respect to the rotational axis 52 of the screw and bowl. FIG. 4 shows in cross-section a side view of the weir plate 28 and choke plate 44. A centrate discharge casing 36 provides a housing over the outside of the head wall 60 and for the weir and choke plate assembly.

As shown in FIG. 2, the weir plates 28 may be attached, e.g., bolted, to the outer surface of the head wall. The weir plates 28 may include a flat bracket 29 and a U-shaped channel 31 which forms a short flow passage 43 (FIG. 3) axially between the head wall and the choke plate. The U-shaped channel 31 may be welded to the bracket 29 of the weir plate 28. A head wall plate 49 extends axially from the outer surface of the bowl head wall 60 and faces in a radial direction an open end of the U-shaped channel 31 of the weir plate 28.

The weir plates 28 are mounted to the head wall 60 adjacent and partially covering drain openings 50 in the wall. The drain openings 50 are generally arranged in an annular array on the head wall. Each drain opening may be at different angular positions on the headwall. All of the drain openings may be at common radial distances from the axis of the head wall.

Each weir plate 28 covers a radially outer portion of a drain opening 50 to define a radially outer edge of a centrate flow passage 43 through the opening 50 in the head wall. The choke plates 44 are each aligned with and adjacent one of the weir plates. In each weir plate, the U-shaped channel 31 has an axial end 58 (FIG. 4) opposite to a flat surface 56 on the corresponding choke plate 44.

Centrate flows 51 radially through a gap 54 between the axial end 58 of the U-shaped channel 31 of the weir plate and the flat surface 56 on the choke plate. These surfaces of the weir and choke plates forming the gap 54 may extend radially for a sufficient distance, e.g., 1 mm to 25 mm, to form a radially extending centrate flow passage 51 through the gap 54. The radial length of the gap 54 is sufficient to cause the centrate to flow 51 radially through the gap.

The desired pond level 15 in the bowl is indicated by the dotted line 53 shown on the choke plate in FIG. 2. The actual pond level of the centrate liquid 15 is shown in FIG. 3. The centrate in the bowl is radially outward of the pond level 15. From the pond, centrate liquid flows 51 through the drain opening 50 and the U-shaped channel 31 towards the choke plate 44 and turns radially outward to flow out a gap 54 between the axial end 58 of the U-shaped channel 31 and a face 56 of the choke plate 44.

A gas filled void 21 in the bowl is radially inward of the pond level 15. Gases may escape through a gap between the head wall plate and U-shaped channel 31 of the weir plate 28.

The radial position of the weir plates 28 on the head wall may be adjusted by means of parallel and generally radial slots 46 in the weir plate bracket 29. These slots receive the bolts holding the weir plate to the head wall. Each weir plate bracket 29 may be marked with gradations 47 that are aligned with a reference circle 48 marked on the head wall. By aligning the proper gradation marking 47 to the reference circle 48 for each of the weir plates, the radial position of each of the weir plates on the head wall may be precisely positioned at a uniform radial distance from the axis of the bowl.

As shown in FIGS. 3 and 4, the discharge clarified liquid, e.g., "centrate", flows through the channel 20 in the bowl towards the head wall 60 and through drain openings 50 arranged annularly in the head wall 60. These openings 50 are preferably arranged in a circle on the head wall, wherein the circle of openings is centered on the rotational axis of the bowl.

The gap (G) 54 between the weir plate 28 and choke plate 44 defines a passage for the centrate flowing to the discharge casing 36. The flow 51 of centrate is generally axially as the centrate moves through the channel 20 and into the opening 50 of the head wall. Because of centrifugal force, the flow 51 quickly turns radially outward as the centrate flows over the edge of the channel 31 on the weir plate 44 and enters the gap 54 between the weir plate and the choke plate. The centrate flows 51 radial outward through the gap 54 and into the centrate discharge casing 36.

The choke plates 44 are mounted on the shaft 64 (FIG. 3) of the bowl or screw conveyor. The choke plate includes a collar 77 that engages the shaft. An upper surface of the collar supports a ball bearing assembly 66, which provides an engagement between the choke plate and a non-rotating axial adjustment mechanism 75. This adjustment mechanism 75 is supported by a pillow box bearing 70 mounted on the shaft 64. The choke plate adjustment mechanism includes a turning wheel 72 for manual or automated adjustment of the gap 54. The turning wheel 72 causes a helically threaded ring 74 of the adjustment mechanism to move the ball bearing assembly 66 axially and thereby axially move the choke plate. The choke plate may include labyrinth seals 78 that engage the axial adjustment mechanism 75 and the head wall 60. A sealing gasket may extend annularly in the labyrinth seal 102.

By adjustment of the turning wheel 72, the width of the gap 54 may be varied between total closure in which substantially no centrate flows out through the weir plate to a gap width in which the centrate does not fill the gap and thus does not impinge on the choke plate.

The choke plates 44 arranged adjacent to the outside of the head wall may include an annular array of discharge openings 45 positioned radially inwardly of the gap 54. These openings 45 provide centrate discharge in the event the gap becomes clogged or the gap unduly restricts the discharge of centrate. If the pond level 15 increases radially inward because of excessive liquid and solid mixture 13 in the centrifuge, the discharge openings 45 allow the centrate to flow into the centrate discharge casing. Instead of openings 45 in the choke plates, lowering the U-shaped side walls of channel 31, also allow the centrate to discharge into the centrate discharge casing.

The centrifuge may be operated in a decanting mode. In this mode, the gap 54 is narrowed by axially advancing the choke plate towards the weir plate or, towards the head wall if the choke plate(s) is inside of the head wall. With the gap narrowed or closed, the pond level 15 in the centrifuge rises radially inward. With the gap narrowed or closed, the centrate flows through optional openings 45 in the choke plate or overflows the side walls of the U-shaped channels 31 that extend from the choke plate. The centrate flows through the openings 45 or over the channel side walls and into the centrate discharge casing 36. By allowing the pond level to rise, the decanting mode provides greater separation of solids from the liquid and the resulting centrate may have less solids than the centrate that would have otherwise flowed through the gap 54.

The decanting mode may be performed periodically or a regular cycle or when the operator of the centrifuge desires to reduce the solids content in the centrate. The decanting mode may also be performed when the operator of the centrifuge desires to reduce the floating solids or foam in the centrifuge which, of course, results in a periodically higher solid or foam content in the centrate which may be treated differently downstream of the centrate casing.

Figure 5:
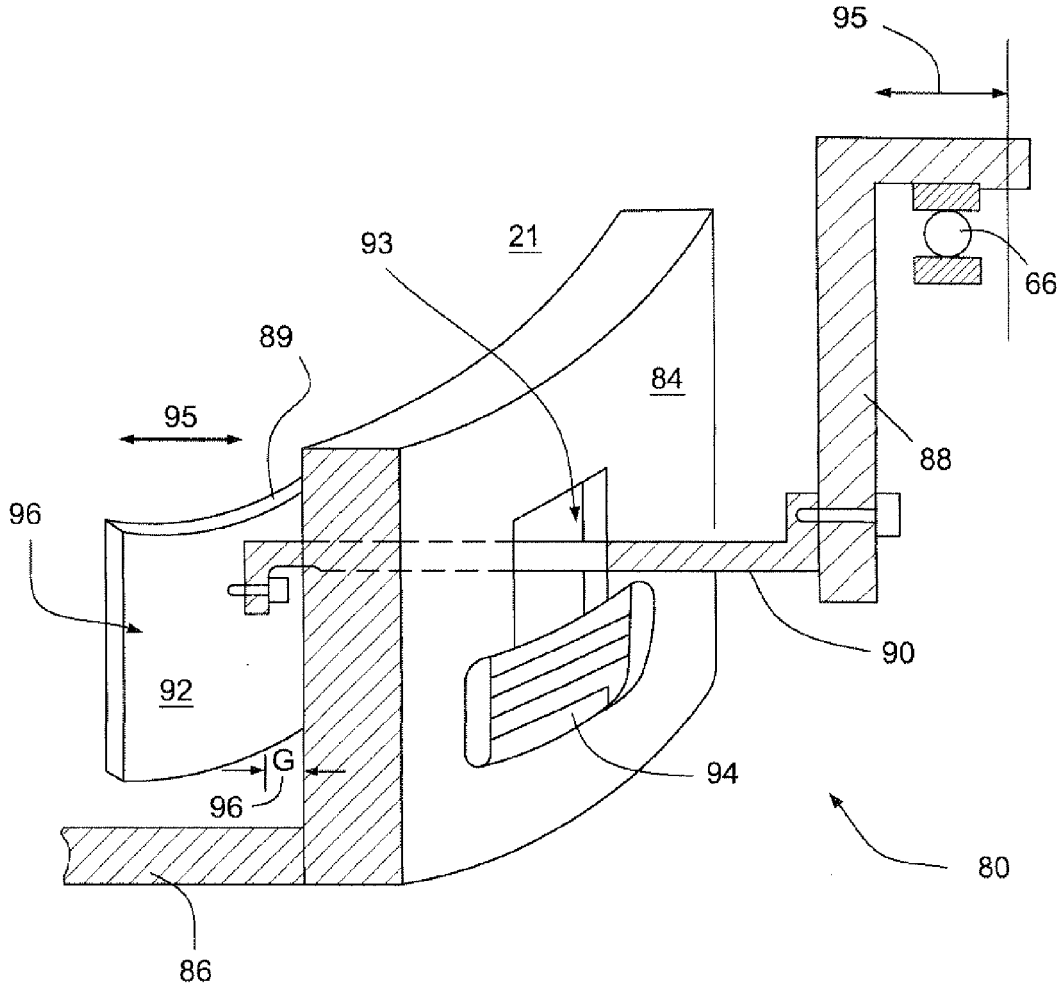
FIG. 5 is a part perspective and part cross-sectional view of an alternative weir and choke plate assembly in which the choke plate is inside of the head wall.
Figure 6:
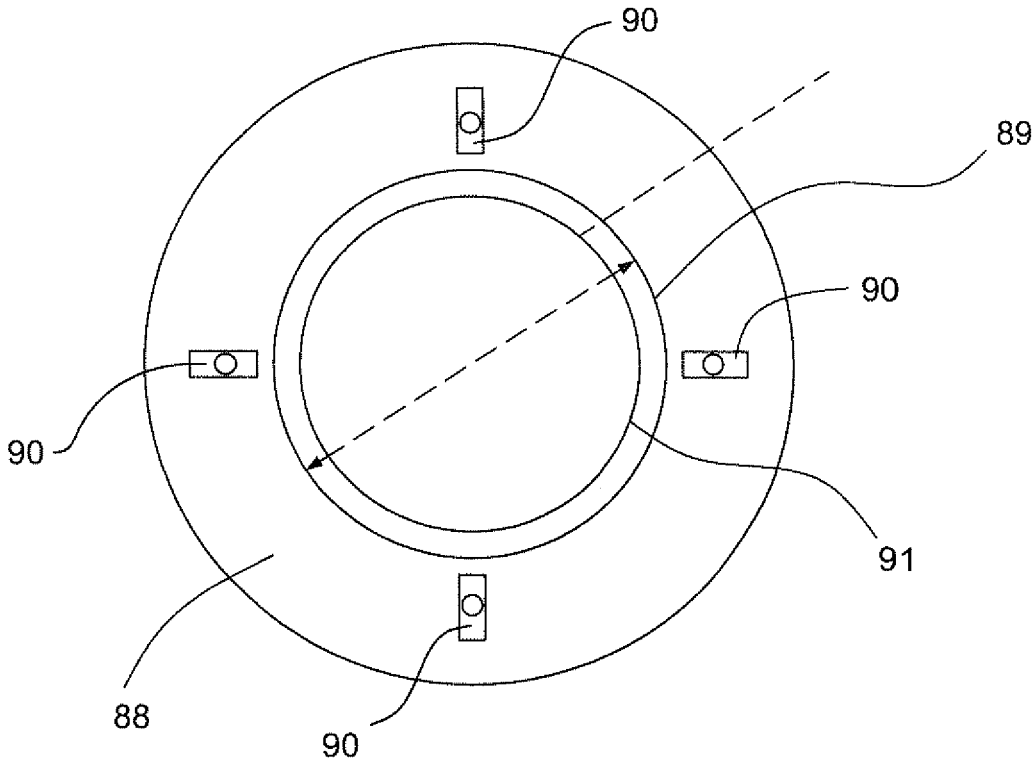
FIG. 6 is a front view of a choke plate for the weir and choke plate assembly shown in FIG. 5.

FIG. 5 is a part perspective and part cross-sectional view of an alternative weir and choke plate assembly 80 in which the choke plates 92 are inside of the head wall 84 of the bowl 86 of a solid bowl helical conveyor centrifuge. FIG. 6 is a front view of a choke plate collar 88 which supports arms 90 that are attached to the choke plates 82. The arms extend through openings 93 in the head wall 84. The weir and choke plate assembly 80 functions to control the pond liquid surface level 15, control the flow of centrate out of the bowl, and seal the gas in the gas filled void 21 in the bowl from ambient air outside of the centrifuge. Gas sealing is helpful to prevent or minimize oxygenation of the liquid solid mixture 13 in the bowl. The choke plate 92 is preferably an annular plate or an annular array of plates having an inside diameter 89 that is slightly greater than an outside diameter of the hub 104 for the screw conveyor. A sealing ring 91 provides a seal between the inner rim of the choke plate 92 and the hub 104 of the screw conveyor. If the choke plate does not serve as a gas seal the sealing ring 91 may be omitted and the choke plate 92 may be equipped with openings 106 (illustrated by dotted lines in the choke plate 92 in FIG. 7) that serve the same purpose as the openings 45 in the choke plate shown in FIG. 4.

The choke plate 92 may be an annular plate forming a ring or an annular array of plates each aligned with one of the openings 93 in the head wall. The choke plate(s) has a front surface 92 that conforms to an inside surface of the head wall 84. The openings 93 allow centrate to flow from the bowl to a discharge casing or channel. The choke plate 92 is attached, e.g., bolted, to an arm 90 extending axially between the plate and the choke plate collar. The arm 92 extends through the opening 93 in the head wall. The choke weir and choke plate assembly 80 includes an annular array of choke plates 82 each adjacent one of the openings 93. Each choke plate is attached by an arm 90 to the choke plate collar in a centrate casing (see 36 in FIGS. 1 and 3).

The choke plate 92 may be advanced axially (see arrow 95) to define the width of a gap 96 between the front surface 92 of the choke plate and the inside surface of the head wall at the rim of the opening 92 in the head wall. The gap 96 has a radial length of preferably 1 mm to 25 mm which corresponds to the overlap between the front surface of the choke plate and the inside surface of the head wall. Adjacent the radial gap 96 is an axial gap 103 between the outer rim of the choke plate and the inner wall of the bowl. The gaps 96 and 103 form a restriction to the centrate flowing (see arrows in FIG. 7) from the bowl to the centrate discharge casing 36.

The choke plate 92 is advanced axially by an operator moving the choke plate collar 88 axially with respect to the shaft of the bowl or screw conveyor. The choke plate 92 may attach to shaft with a pillow box bearing (70 in FIG. 3) and may be moved axially by an axial adjustment mechanism (75 in FIG. 3). The mechanisms for axially moving the choke plate shown in FIG. 3 may be also applied to the choke plate 82.

The weir plates 94 mounted to the head wall 84 may be generally rectangular plates having an inside surface conforming to an outer surface of the head wall adjacent to an opening 93 in the head wall. The weir plates 94 may be bolted to the head wall 84 and adjusted radially with respect to the head wall in a manner similar to the weir plate bracket 29 shown in FIG. 2.

Figure 7:
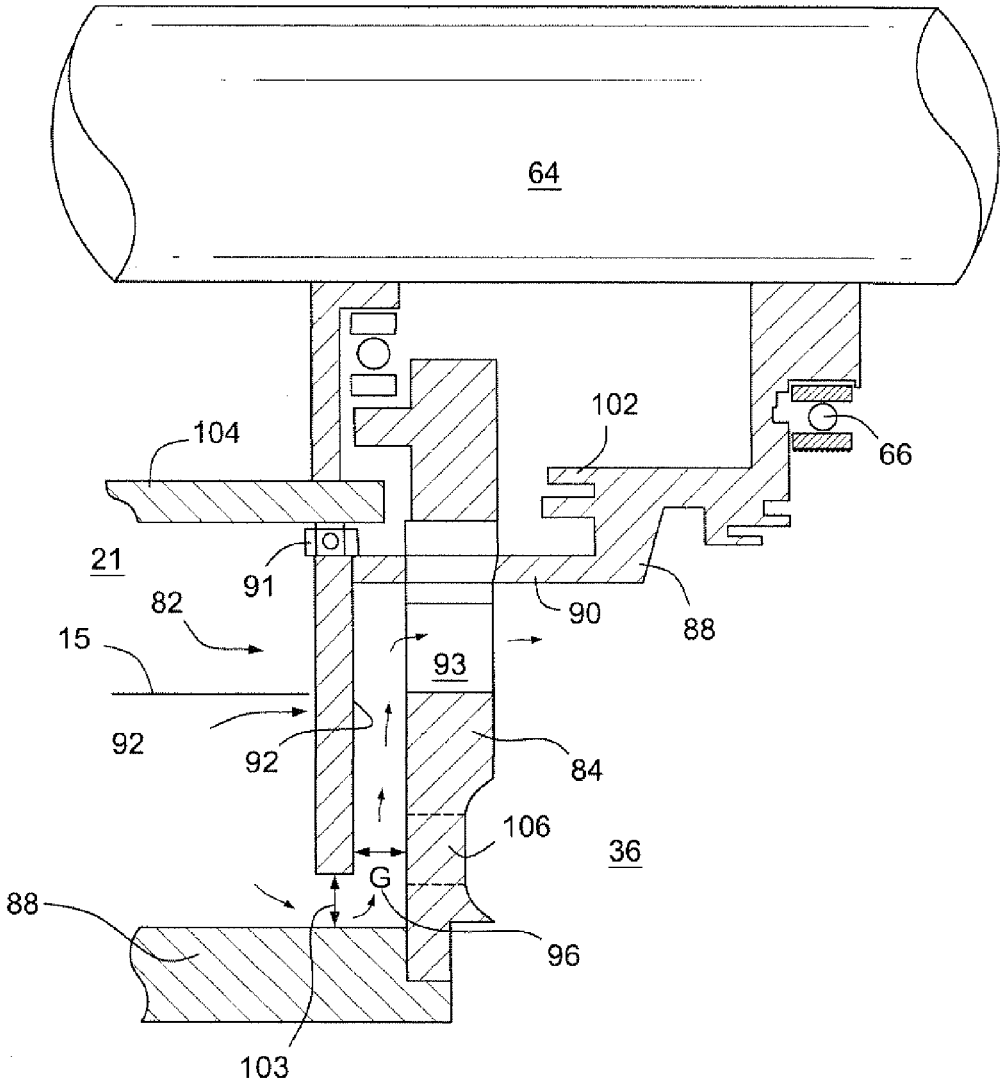
FIG. 7 shows another embodiment of the weir and choke plate assembly shown in FIGS. 5 and 6.

FIG. 7 shows the embodiment of the weir and choke plate assembly shown in FIGS. 5 and 6 in which the assembly substantially isolates the gases in the void in the bowl from the ambient air outside of the centrifuge. The annular choke plate 82 generally prevents ambient air from mixing with the gases in the void in the bowl. A seal 91 between the inner rim of the choke plate and the hub 104 of the screw conveyor prevents gas passage between the void 21 and ambient air.

The solid bowl centrifuges disclosed herein have a rotating bowl having an end region with drain openings for clarified liquid. The drain openings are aligned with a weir plate and choke plate assembly that provides an adjustable radial gap for varying a level of the liquid in the centrifuge bowl during operation of the centrifuge. The weir and choke plate assembly has opposing parallel plates rotating together with the centrifuge bowl.

The choke plate may be arranged inside the bowl to face an inner surface of the head wall or outside the bowl to face an outer edge of a weir plate. The choke plate may include radially inward openings through which centrate may flow during a decanting function.

The choke plate may alternatively be used to seal the gas filled void in the centrifuge against the out atmosphere. The centrate exits solely through the radial gap. The centrate in the gap forms an effective gas seal between the gas filled void 21 in the centrifuge and ambient air. The gas filled void is radially inward of the liquid annular ring formed by the spinning bowl.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

We claim:

1. A centrifuge for separating solid-liquid mixtures comprising:

a rotating bowl having a head wall with at least one drain opening for clarified liquid, said bowl having a rotational axis;

a weir plate fixed to the head wall of the bowl and rotating with bowl, wherein the weir plate is aligned with the at least one drain opening;

a choke plate coupled to and rotating with the rotating bowl, the choke plate having a surface axially aligned with the drain opening or the weir plate, wherein said choke plate moves with respect to the head wall;

a gap between the drain opening or the weir plate, wherein the gap has a radially inward inlet receiving the clarified liquid from the bowl and a radially outward outlet for discharging the clarified liquid from the bowl, and a drain opening in the choke plate radially inward of the weir plate.

2. The centrifuge of claim 1 further comprising a screw assembly within the bowl and axially aligned with the bowl, wherein the screw assembly includes a helical screw blade extending proximate to an inner wall of the bowl.

3. The centrifuge of claim 1 further comprising an axial adjustment mechanism coupled to the choke plate, wherein the axial adjustment mechanism moves the choke plate axially to adjust an axial width of the gap.

4. The centrifuge of claim 1 further comprising sealing ring between the choke plate and a hub of the rotating screw conveyor.

5. The centrifuge of claim 1 further wherein the weir plate moves radially outward for a decanting mode operation.

6. The centrifuge of claim 1 wherein the choke plate is inside the bowl, and an arm extends between the choke plate and a choke plate collar outside of the bowl.

7. The centrifuge of claim 6 wherein the internal choke plate forms a gas seal between a gas void in the bowl and ambient air outside of the centrifuge.

8. A method for clarifying liquid in a liquid and solid mixture using a solid bowl centrifuge having a rotating bowl, a choke plate and a weir plate, the method comprising:

feeding the liquid and solid mixture into the bowl;

rotating the bowl to cause the liquid and solid mixture in the bowl to form an annulus having an inner annular liquid surface by rotating the bowl;

draining clarified liquid from the liquid and solid mixing by draining a radially inward portion of the annulus through an opening in the head wall and over a radially inward edge of the weir plate fixed to and rotating with the head wall;

forming a gap between the choke plate and the head wall or weir plate, wherein the gap extends in a generally radial direction and includes a radially inward inlet to receive the clarified liquid and a radially outward outlet to discharge the clarified liquid;

narrowing the gap by axially advancing the choke plate towards the head wall, advancing the inner annular liquid surface radially inward, and draining decanted clarified liquid through an opening in the choke plate, wherein the opening in the choke plate is radially inward of the gap.

9. The method of claim 8 further comprising moving the choke plate axially with respect to a rotational axis of the bowl, wherein the axial movement of the choke plate varies the annular gap.

10. The method of claim 8 further comprising forming a gas seal between ambient atmosphere and a gas filled void in the bowl which is radially inward of the annular liquid surface.

11. The method of claim 8 further comprising decanting the clarified liquid including narrowing the gap by moving the weir plate radially outward, axially advancing the choke plate towards the head wall, advancing the inner annular liquid surface radially inward, and draining decanted clarified liquid through the gap between the weir plate and the choke plate.

12. The method of claim 8 wherein the step of decanting is performed periodically.

* * * * *